US009004480B2

(12) United States Patent
Hsu

(10) Patent No.: US 9,004,480 B2
(45) Date of Patent: Apr. 14, 2015

(54) WEB PRODUCT FOLDING AND STACKING MACHINE

(75) Inventor: Chi Pin Hsu, Taoyuan (TW)

(73) Assignee: Chan Li Machinery Co., Ltd., Taoyuan (TW)

( * ) Notice: Subject to any disclaimer, the term of this patent is extended or adjusted under 35 U.S.C. 154(b) by 470 days.

(21) Appl. No.: 13/477,173

(22) Filed: May 22, 2012

(65) Prior Publication Data

US 2013/0109558 A1 May 2, 2013

(30) Foreign Application Priority Data

Oct. 28, 2011 (TW) ..... 100139490 A

(51) Int. Cl.
*B65H 45/24* (2006.01)

(52) U.S. Cl.
CPC ..... *B65H 45/24* (2013.01); *B65H 2406/30* (2013.01)

(58) Field of Classification Search
USPC ..... 270/32, 39.01, 39.02, 39.05, 39.06, 41; 493/413, 418, 424, 430, 433, 451
See application file for complete search history.

(56) References Cited

U.S. PATENT DOCUMENTS

| | | | | |
|---|---|---|---|---|
| 4,406,650 | A | 9/1983 | Felix | |
| 4,770,402 | A * | 9/1988 | Couturier | 270/39.02 |
| 4,874,158 | A * | 10/1989 | Retzloff | 270/39.02 |
| 5,088,707 | A * | 2/1992 | Stemmler | 270/39.02 |
| 5,924,808 | A * | 7/1999 | Sides, II | 400/679 |
| 6,641,358 | B2 * | 11/2003 | Schmidt et al. | 414/801 |
| 8,128,079 | B2 * | 3/2012 | Hsu | 270/39.02 |
| 2011/0068527 | A1 * | 3/2011 | Hsu | 270/39.02 |

FOREIGN PATENT DOCUMENTS

| | | | |
|---|---|---|---|
| CN | 101670953 | A | 3/2010 |
| JP | H07-53122 | A | 2/1995 |
| JP | 2011-63440 | A | 3/2011 |
| TW | 201111586 | A | 4/2011 |

* cited by examiner

*Primary Examiner* — Leslie A Nicholson, III
(74) *Attorney, Agent, or Firm* — Rosenberg, Klein & Lee

(57) ABSTRACT

A web product folding and stacking machine includes two folding line making rolls, two folding fingers, a first carrier unit, a stoppage unit and a holder. The folding line making rolls and the folding fingers are operated to fold up web products on the first carrier unit to form a stack of interfolded web products. Further, there is at least one suction device arranged on the top surface of the first carrier unit to suck the web products nearing the top surface of the first carrier unit and facilitate accurate stacking of the interfolded web products.

12 Claims, 9 Drawing Sheets

WEB PRODUCT FOLDING AND STACKING MACHINE

BACKGROUND OF THE INVENTION

The present invention is related to a folding machine and more particularly to a web product folding and stacking machine, which is practical for making a stack of interfolded web products.

Please refer to FIG. 1. A conventional web product folding and stacking machine 10 is shown comprising two folding line making rolls 11, two folding fingers 13, a first carrier unit 15, a stoppage unit 17 and a holder 19. The two folding line making rolls 11 are rotatable in reversed directions to cause each fed web product 12 between two folding making rolls 11 forming a folding line. The folding fingers 13 are adapted to stack up folded web products 12 on the first carrier unit 15.

When the number of interfolded web products 12 on the first carrier unit 15 reaches the set value, the stoppage unit 17 is extended out to isolate the interfolded web products 12. The holder 19 is adapted to receive the interfolded web products 12 from the first carrier unit 15 and to match with the stoppage unit 17 for delivering the interfolded web products 12. Moreover, two folding line making rolls 11 and two folding fingers 13 are adapted to fold and stack web products 12 on the first carrier unit 15 continuity.

The surface of the first carrier unit 15 is slippery, so that the web products 12 may leave the predetermined position of the first carrier unit 15 during the initial stage of the stacking operation of the folding fingers 13 to stack up web products 12 on the first carrier unit 15. Moreover, as the stoppage unit 17 is extended out to isolate the interfolded web products 12, the stoppage unit 17 or the second web product 123 may pull the first web product 121 on the first carrier unit 15 to cause the first web product 121 to leave predetermined position, resulting in unkempt stack of interfolded web products 12 during the initial stacking stage.

SUMMARY OF THE PRESENT INVENTION

It is, therefore, the main object of the present invention to provide a web product folding and stacking machine, which has at least one suction device arranged on the top surface of a first carrier unit to suck the web products on the top surface of the first carrier unit during the initial stacking stage and facilitate accurate stacking of the interfolded web products.

It is another object of the present invention to provide a web product folding and stacking machine, which has at least one suction device arranged on the top surface of a first carrier unit to suck the web products on the top surface of the first carrier unit, so that the web product folding and stacking machine is capable of folding and stacking harder web products and facilitating accurate stacking of the interfolded web products.

To achieve these and other objects of the present invention, the present invention provides a web product folding and stacking machine, comprising: two folding line making rolls arranged in proximity to each other for transferring web products and causing each the web product to form a folding line thereon; two folding fingers adapted to fold up each the web products along the folding line thereof for enabling the web products to be stacked up in an interfolded condition; a first carrier unit, having a first surface and a second surface opposite to the first surface, wherein the first surface of the first carrier unit is adapted to carrying the interfolded web product; at least one suction device arranged on the first surface of the first carrier unit for sucking the interfolded web product on the first surface of the first carrier unit; a stoppage unit adapted to isolate the interfolded web products; and a holder adapted to hold the interfolded web products.

In one embodiment of aforesaid web product folding and stacking machine, further comprising a second carrier unit adapted to receive the interfolded web product from the first carrier unit, and the holder adapted to receive the interfolded web products from the second carrier unit.

In one embodiment of aforesaid web product folding and stacking machine, wherein the stoppage unit and the holder are movable in a first direction, the second carrier unit is movable in a second direction, and the first direction is perpendicular to the second direction.

In one embodiment of aforesaid web product folding and stacking machine, wherein the first carrier unit comprises a plurality of fingers, and the suction device is arranged on the fingers.

In one embodiment of aforesaid web product folding and stacking machine, wherein the suction device is adapted to form negative pressure.

In one embodiment of aforesaid web product folding and stacking machine, wherein the folding line making rolls comprise a first folding line making roll and a second folding line making roll, and the first folding line making roll and the second folding line making roll comprise a plurality longitudinal protrusions and a plurality of longitudinal grooves.

In one embodiment of aforesaid web product folding and stacking machine, wherein the longitudinal protrusions and the longitudinal grooves of the first folding line making roll are engaged into the longitudinal grooves and the longitudinal protrusions of the second folding line making roll respectively.

In one embodiment of aforesaid web product folding and stacking machine, wherein the first carrier unit and the stoppage unit are finger shape.

In one embodiment of aforesaid web product folding and stacking machine, wherein the suction device is adapted to form negative pressure.

In one embodiment of aforesaid web product folding and stacking machine, wherein the holder is adapted to receive the interfolded web product from the first carrier unit.

DETAILED DESCRIPTION OF THE PREFERRED EMBODIMENTS

Figure 1:
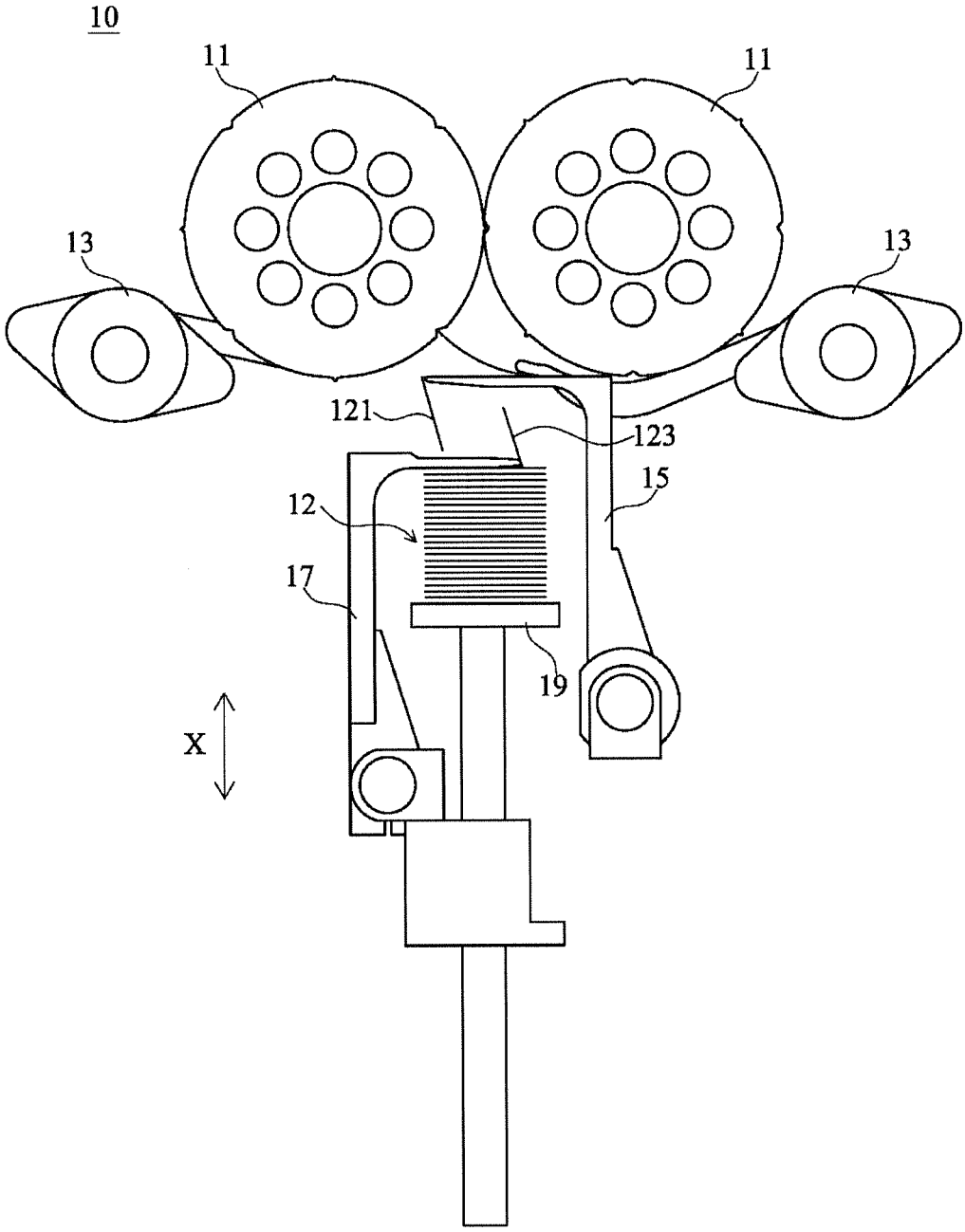
FIG.1 (PRIOR ART)
FIG. 1 is a schematic structural view of a web product folding and stacking machine according to the prior art.
Figure 2:
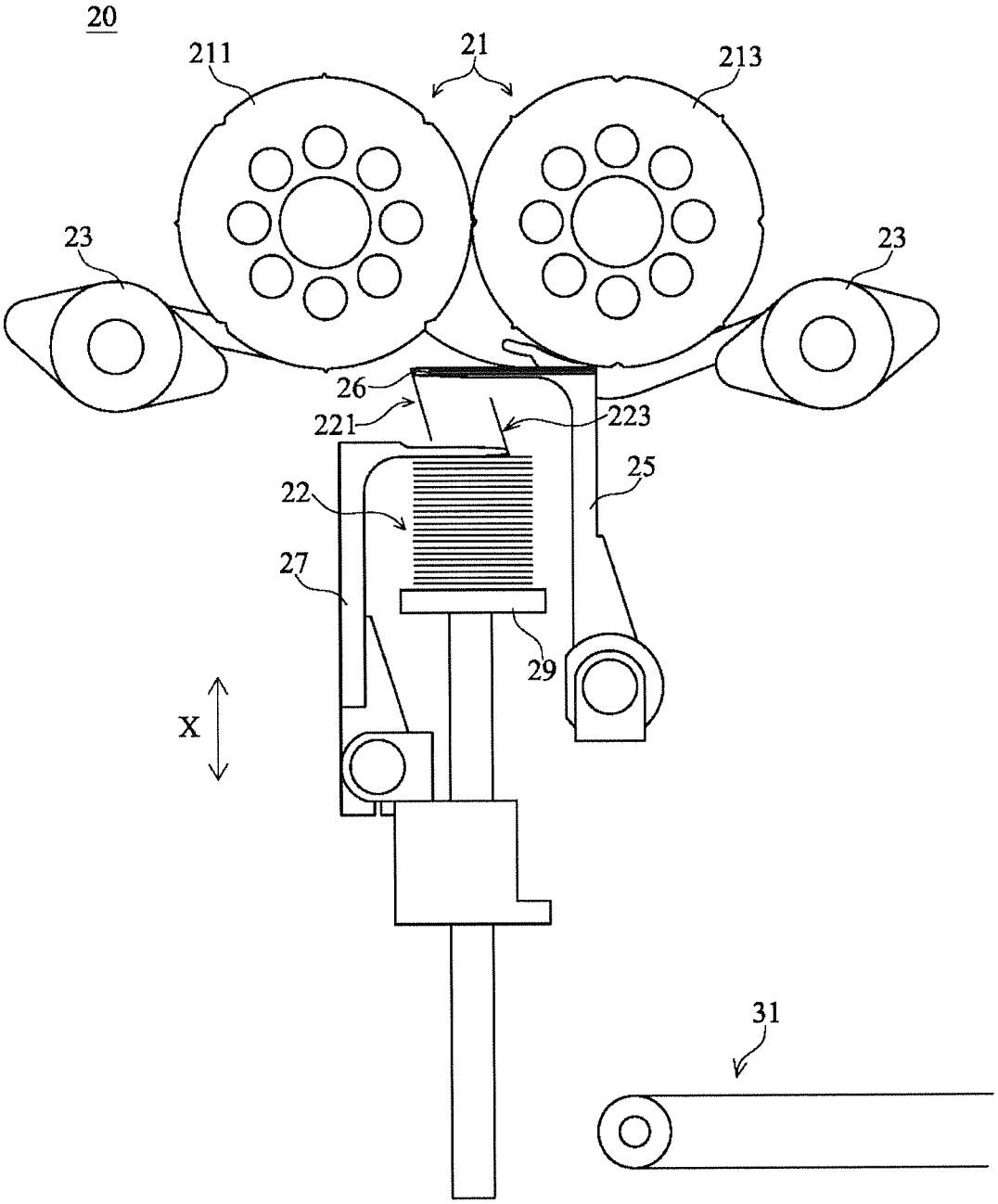
FIG. 2 is a schematic structural view of a web product folding and stacking machine in accordance with an embodiment of the present invention.

Please refer to FIG. 2. A web product folding and stacking machine in accordance with the present invention is shown. The web product folding and stacking machine 20 comprises two folding line making rolls 21, two folding fingers 23, a first carrier unit 25, a stoppage unit 27 and a holder 29. Subject to the use of the web product folding and stacking machine 20, web products 22 can be folded and stacked up neatly.

Figure 3:
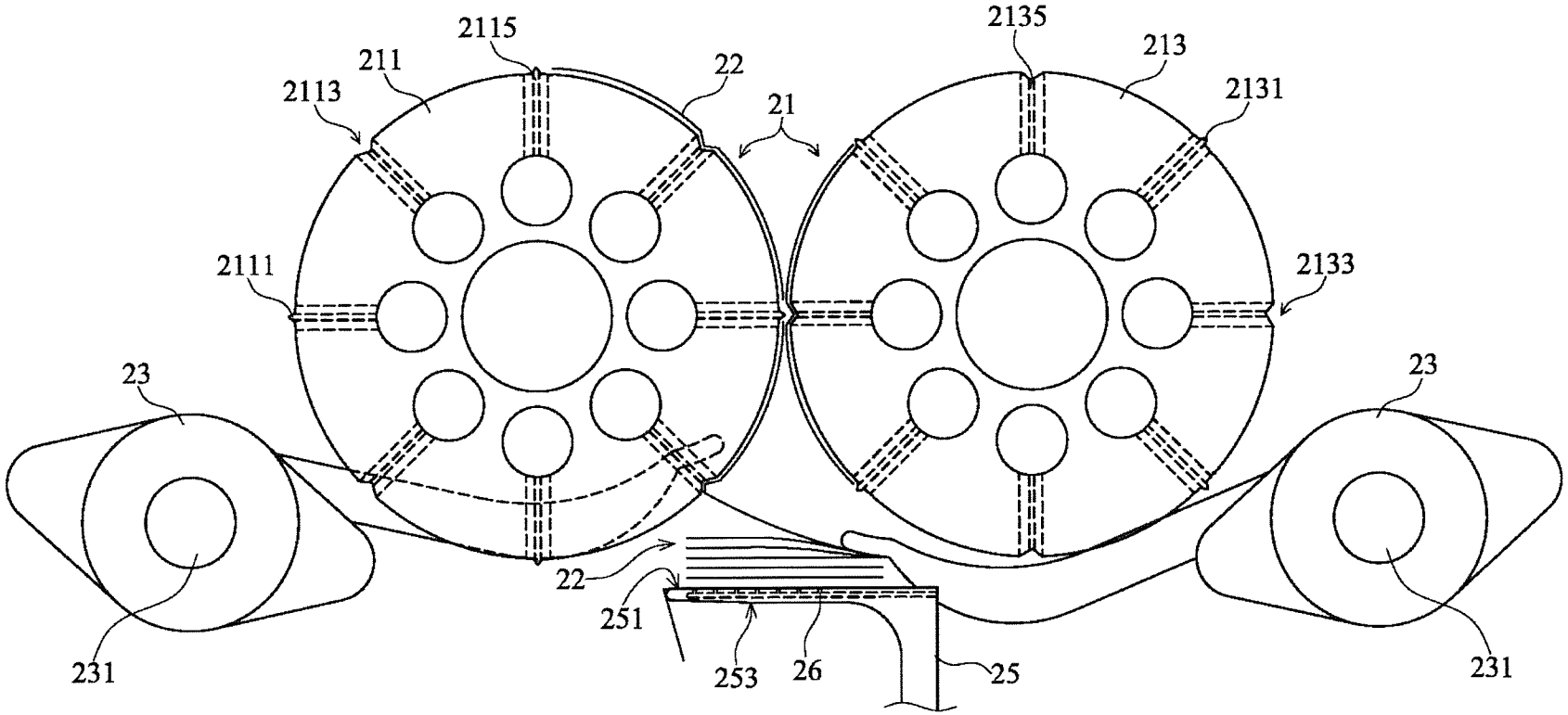
FIG. 3 is a schematic enlarged partial view of the web product folding and stacking machine in accordance with the present invention.

The two folding line making rolls 21 are rotatable in two reversed directions to cause each transferring web product 22 to form a folding line for folding and stacking. Please referring to FIG. 3, a first carrier unit 25 comprises a first surface 251 and a second surface 253, wherein the first surface 251 of the first carrier unit 25 is adapted to bear the web products 22. There one or more suction device(s) 26 arranged on first surface 251 of the first carrier unit 25 for forming a negative pressure and sucking the web products 22 bore by the first surface 251 of the first carrier unit 25.

Figure 4A:
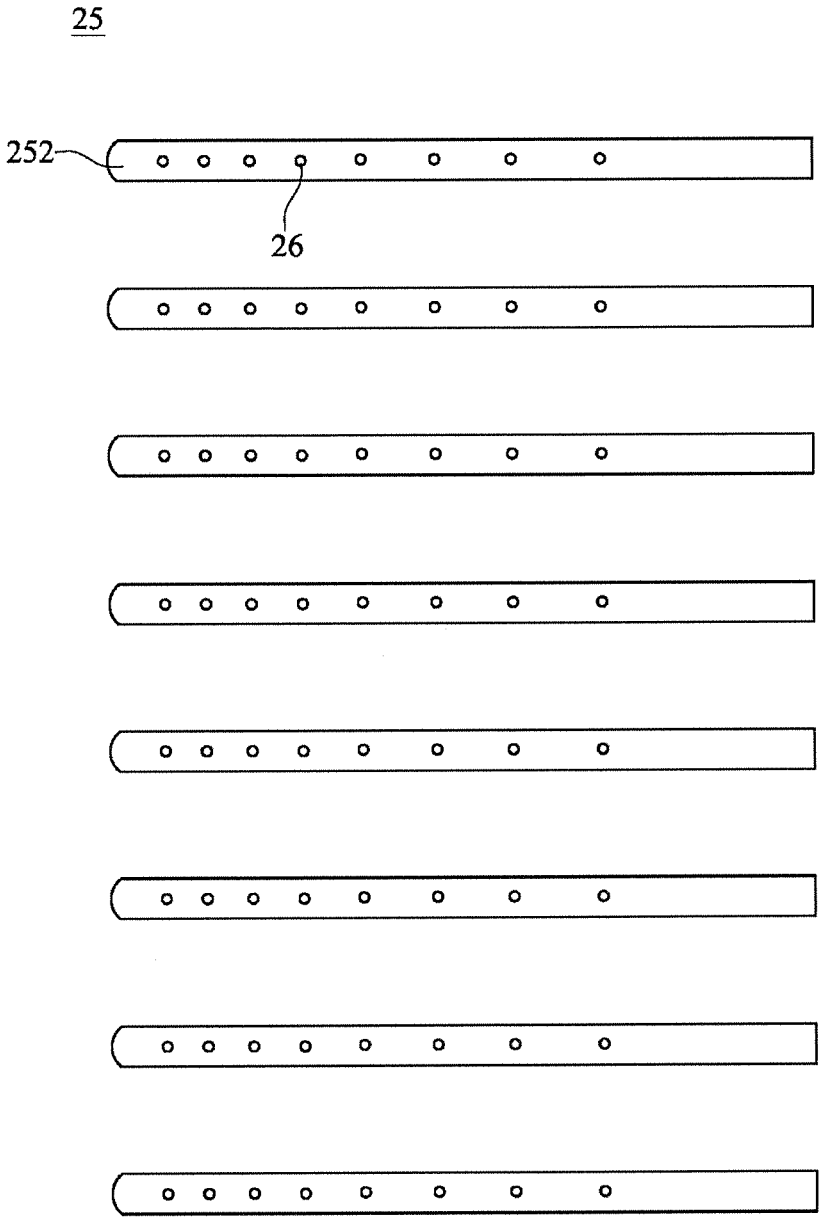
FIG. 4A is a schematic top view of the first carrier unit of the web product folding and stacking machine in accordance with an embodiment of the present invention.
Figure 4B:
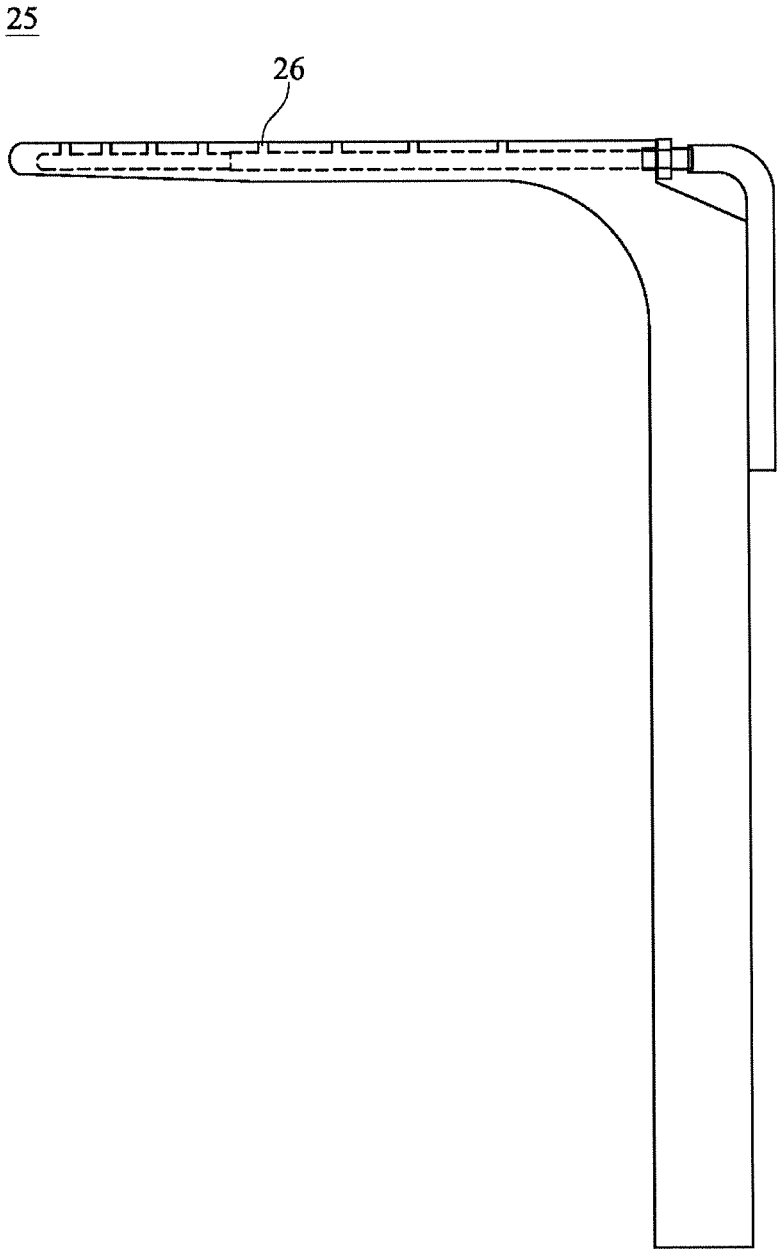
FIG. 4B is a schematic side view of the first carrier unit of the web product folding and stacking machine in accordance with an embodiment of the present invention.

Please referring to FIG. 4A to FIG. 4B, in one embodiment of the invention, the first carrier unit 25 comprises a plurality of fingers 252, and the suction devices 26 are evenly arranged on each surface of the fingers 252. For example, the suction devices 26 can be holes for forming negative pressure. In certain embodiments, the intervals between each two adjacent suction devices 26 are the same. In other embodiments, the intervals between each two adjacent suction devices 26 are different. Both are able to improve the efficacy of the suction devices 26 sucking the web products 22.

The two folding line making rolls 21 include a first folding line making roll 211 and a second folding line making roll 213 to form a folding line on the web product 22 between two folding line making rolls 21. The first folding line making roll 211 has a plurality of longitudinal protrusions 2111 and a plurality of longitudinal grooves 2113 alternatively arranged around the periphery thereof. Similar to the first folding line making roll 211, the second folding line making roll 213 has a plurality of longitudinal protrusions 2131 and a plurality of longitudinal grooves 2133 respectively alternatively arranged around the periphery thereof.

The first folding line making roll 211 and the second folding line making roll 213 are arranged in a parallel manner in proximity to each other such that the longitudinal protrusions 2111 of the first folding line making roll 211 can be engaged into the longitudinal grooves 2133 of the second folding line making roll 213; the longitudinal protrusions 2131 of second folding line making roll 213 can be engaged into the longitudinal grooves 2113 of the first folding line making roll 211.

The first folding line making roll 211 and the second folding line making roll 213 are rotatable in reversed directions, for example, the first folding line making roll 211 is rotatable in clockwise direction and the second folding line making roll 213 is rotatable in counter-clockwise direction. When one web product 22 is being transferred through the gap in between the first folding line making roll 211 and the second folding line making roll 213 during rotation of the first folding line making roll 211 and the second folding line making roll 213 in two reversed directions, the web product 22 will be squeezed by one longitudinal protrusion 2111 or 2131 of the first folding line making roll 211 or second folding line making roll 213 and one corresponding longitudinal groove 2133 or 2113 of the second folding line making roll 213 or first folding line making roll 211, thereby causing formation of a folding line on the web product 22.

Suction holes 2115 and 2135 are respectively formed in the first folding line making roll 211 and the second folding line making roll 213 corresponding to the respective longitudinal protrusions 2111 and 2131 and the respective longitudinal grooves 2133 and 2113 for sucking in air such that the folding line making rolls 21 can suck or release the web product 22. Further, the two folding fingers 23 respectively pivotally supported on a respective pivot member 231 at a lower elevation relative to the folding line making rolls 21. Thus, the folding fingers 23 can be turned about the respective pivot member 231 within a predetermined angle to fold the web product 22 on the first surface 251 of the first carrier unit 25 along its folding line.

Further, when the thickness of interfolded web products 22 on the first carrier unit 25 reaches a certain extent, the first carrier unit 25 will be lowered slowly in a first direction X, so that the folding line making rolls 21 and the folding fingers 23 are able to fold and stack the web products 22 on the first carrier unit 25.

The folding line making rolls 21 are to form a folding line along the central axis of each web product 22 being transferred. The folding fingers 23 are adapted to fold up each web product 22 along the folding line and to stack up the folded web products 22 in an interfolded status neatly. Further, the web products 22 can be toilet paper, facial tissues, paper towels, wet tissues or the like. Thus, a predetermined number of interfolded web products 22 can be packed in a commercial pop-up tissue box.

The stoppage unit 27 is adapted to separate interfolded web products 22. In actual application, the amount of interfolded web products 22 can be known subject to the number of operation cycles of the folding fingers 23. When the number of interfolded web products 22 reaches the set value, the stoppage unit 27 is extended out to isolate the interfolded web products 22. The holder 29 is adapted to hold the interfolded web products 22 and to match with the stoppage unit 27 for enabling the interfolded web products 22 to be delivered to a predetermined location.

In one embodiment of the present invention, the stoppage unit 27 is connected to the holder 29 and movable with the holder 29 in the first direction X to a predetermined location, for example, the stoppage unit 27 and the holder 29 can be moved to carry the interfolded web products 22 to a conveyer 31.

The suction devices 26 of the first carrier unit 25 is capable of sucking the web products 22, eliminating the problems of the prior art technique such as poor alignment of the interfolded web products 22 during the initial stacking stage. For example, folding fingers 23, the stoppage unit 27 and/or the second web product 223 can't pull the first web product 221 sucked by the suction devices 26 to leave predetermined position, facilitating making of a neat stack of interfolded web products 22. In contrast, the web products 12 may leave the predetermined position of the first carrier unit 15 during the initial stage of the stacking operation of the folding fingers 13 to stack up web products 12 on the first carrier unit 15. Moreover, as the stoppage unit 17 is extended out to isolate the interfolded web products 12, the folding fingers 13, the stoppage unit 17 and/or the second web product 123 thereon may pull the first web product 121 on the first carrier unit 15 to cause the first web product 121 to leave predetermined position, resulting in unkempt stack of interfolded web products 12 during the initial stacking stage.

Figure 5A:
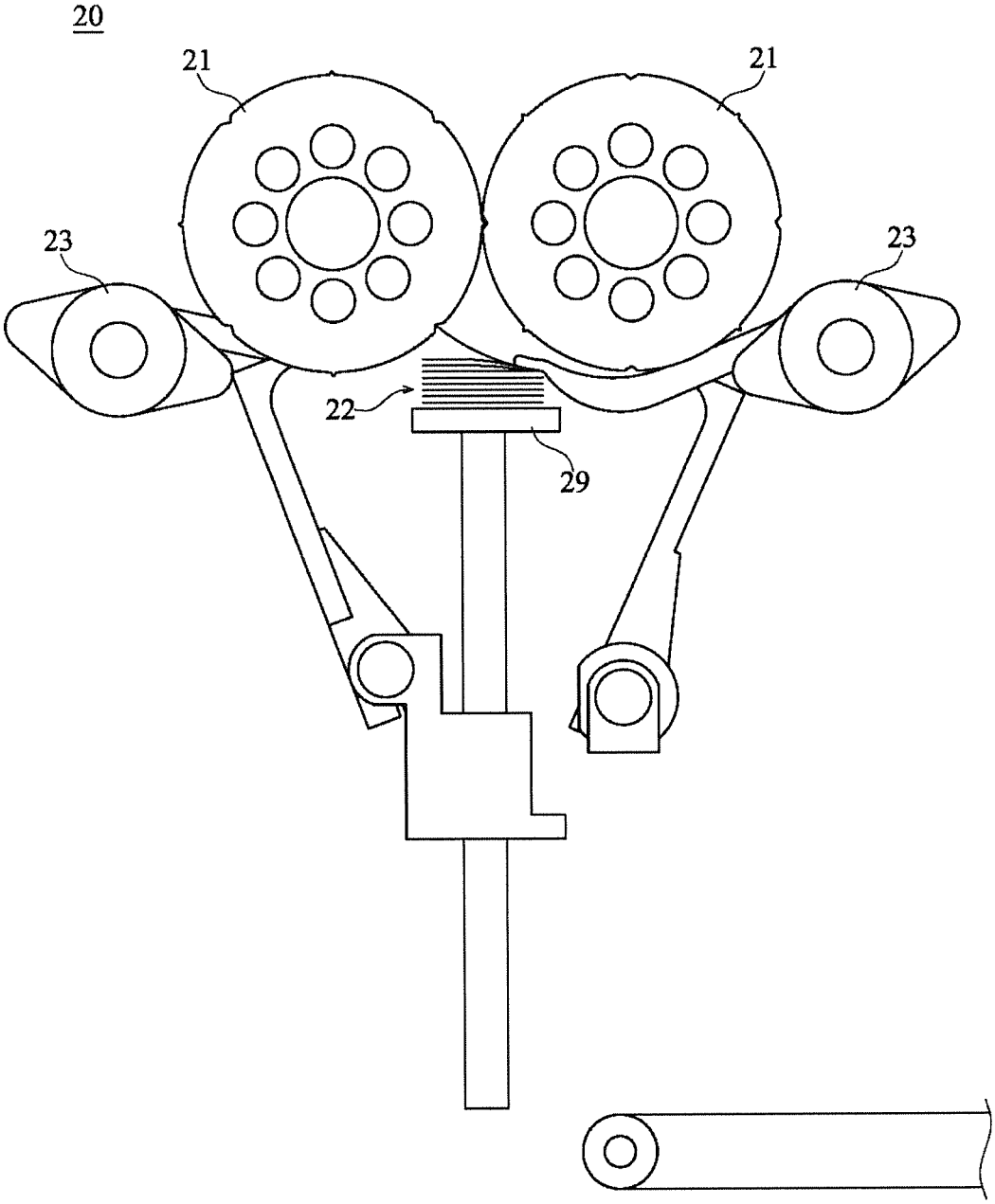
FIGS. 5A-5D illustrate the operation flow of the web product folding and stacking machine in accordance with the present invention.

Please refer to FIGS. 5A through 5D. The operation of the web product folding and stacking machine is shown. When the web product folding and stacking machine 20 is started, the holder 29 is moved to a predetermined position, and then the folding line making rolls 21 and the folding fingers 23 are operated to fold web products 22 into a stack of interfolded web products 22 on the holder 29, as shown in FIG. 5A.

When the number of the interfolded web products 22 on the holder 29 reaches a predetermined quantity, the stoppage unit 27 is extended out to isolate the interfolded web products 22, and then the stoppage unit 27 is moved with the interfolded web products 22 and the holder 29 in the first direction X to a predetermined location for delivery.

Figure 5B:
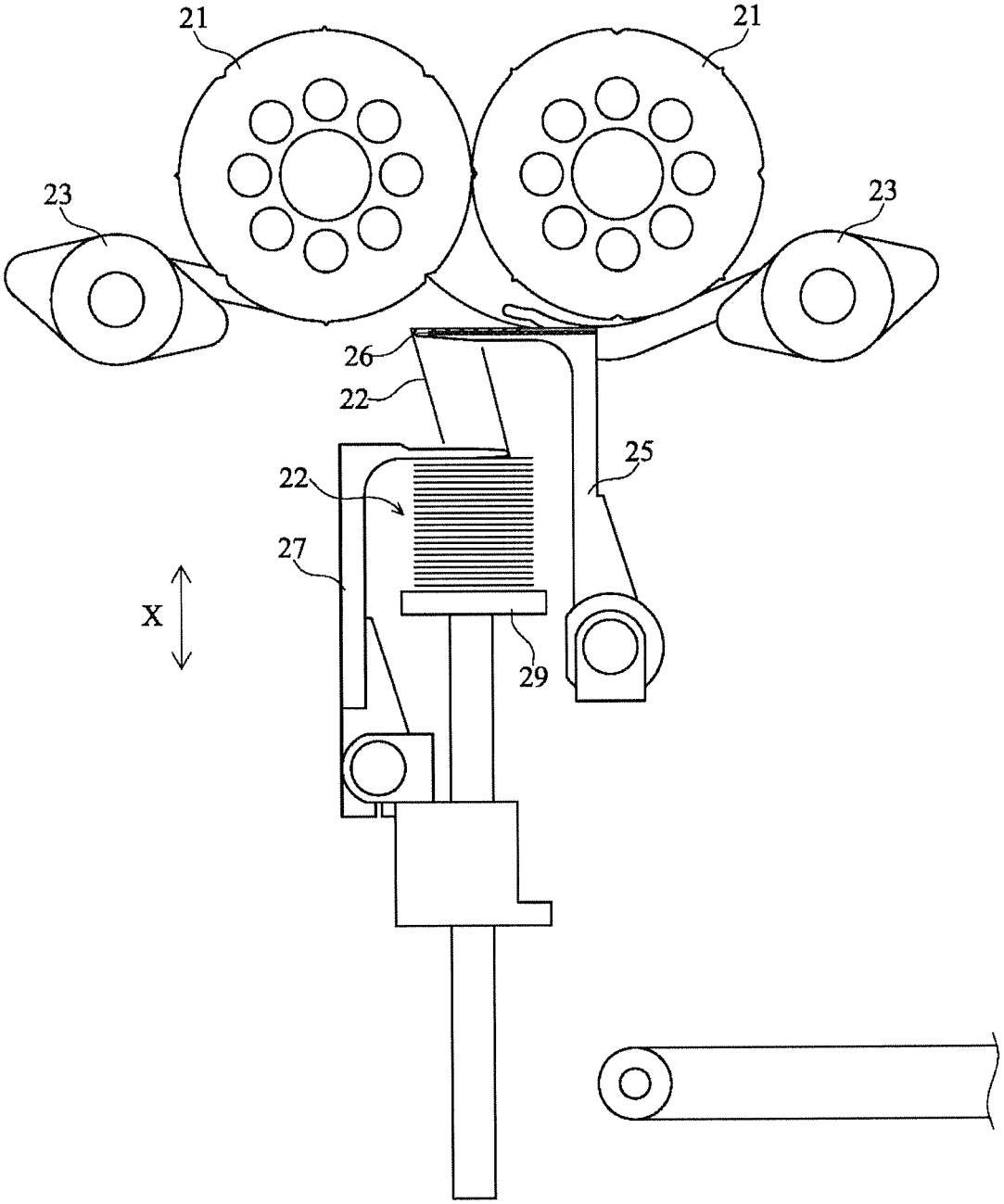

Further, when the stoppage unit 27 is extended out, the first carrier unit 25 is simultaneously extended out. The folding line making rolls 21 and the folding fingers 23 can continuously fold up web products 22 on the first carrier unit 25. The first carrier unit 25 has at least one suction device(s) 26 mounted thereon for sucking the stacked web products 25 on the first carrier unit 25, as shown in FIG. 5B.

The suction device 26 arranged on the first carrier unit 25 is able to form a negative pressure to suck the web product 22 and avoid poor alignment of the interfolded web products 22 during the initial stacking stage. For example, as first carrier unit 25 is extended out, the suction device 26 will be switched on for forming a negative pressure to suck the web product 22 near the surface of the first carrier unit 25.

Figure 5C:
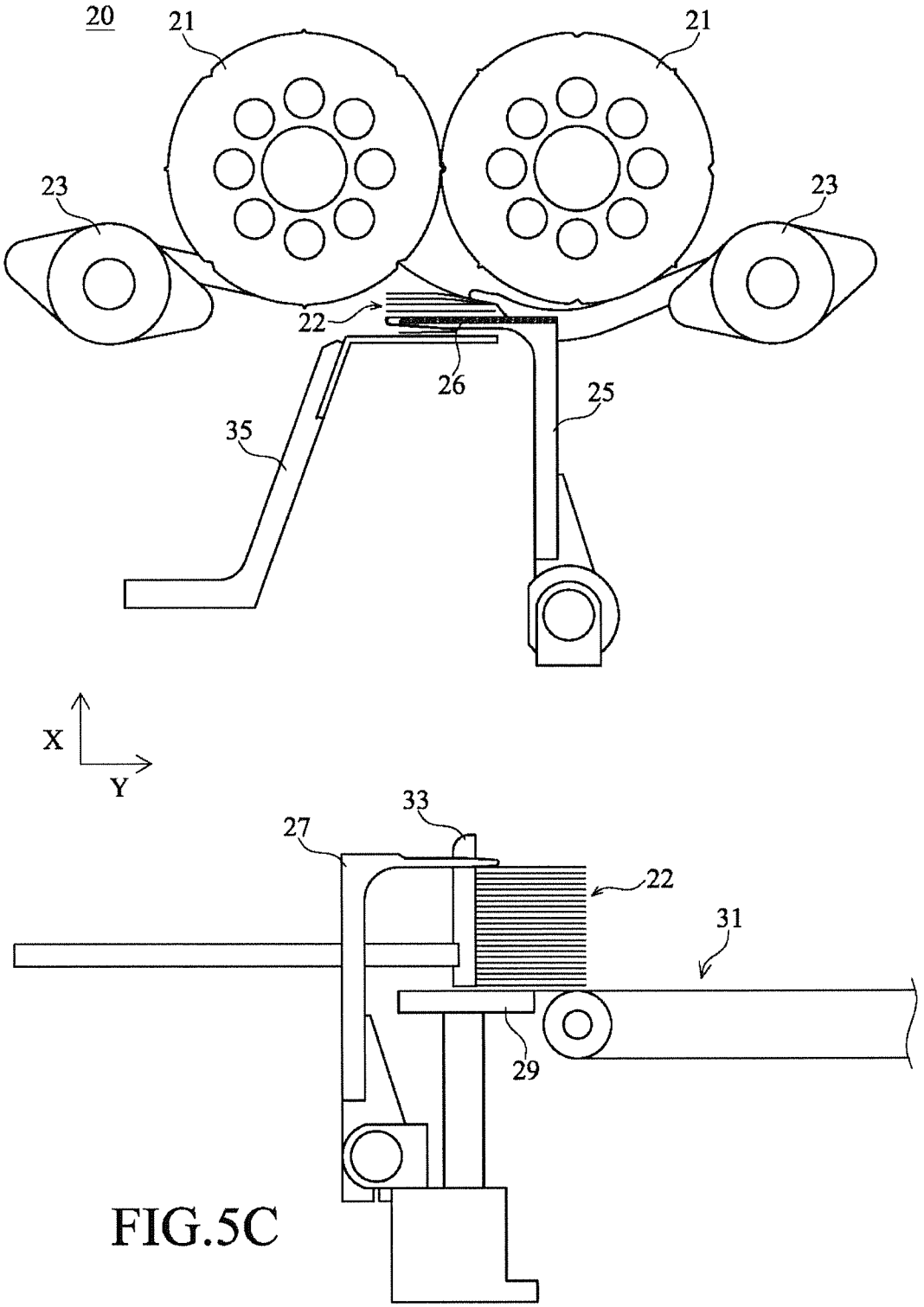

In one embodiment of the present invention, the web product folding and stacking machine 20 further comprises a second carrier unit 35 adapted to receive the stack of interfolded web products 22 from the first carrier unit 25. The second carrier unit 35 can be extended out along, for example, the second direction Y, and the first carrier unit 25 will be retracted when the second carrier unit 35 is extended out, enabling the stack of interfolded web products 22 to be placed on the second carrier unit 35. When the stack of interfolded web products 22 is shifted from the first carrier unit 25 to the second carrier unit 35, the folding line making rolls 21 and the folding fingers 23 keep operating. Following increasing of the number of interfolded web products 22, the second carrier unit 35 is lowered along the first direction X. Further, after delivery of interfolded web products 22 to a predetermined location by the stoppage unit 27 and the holder 29, a push unit 33 is operated to push the interfolded web products 22 away from the holder 29 to the conveyer belt 31 for further delivery, as shown in FIG. 5C.

Figure 5D:
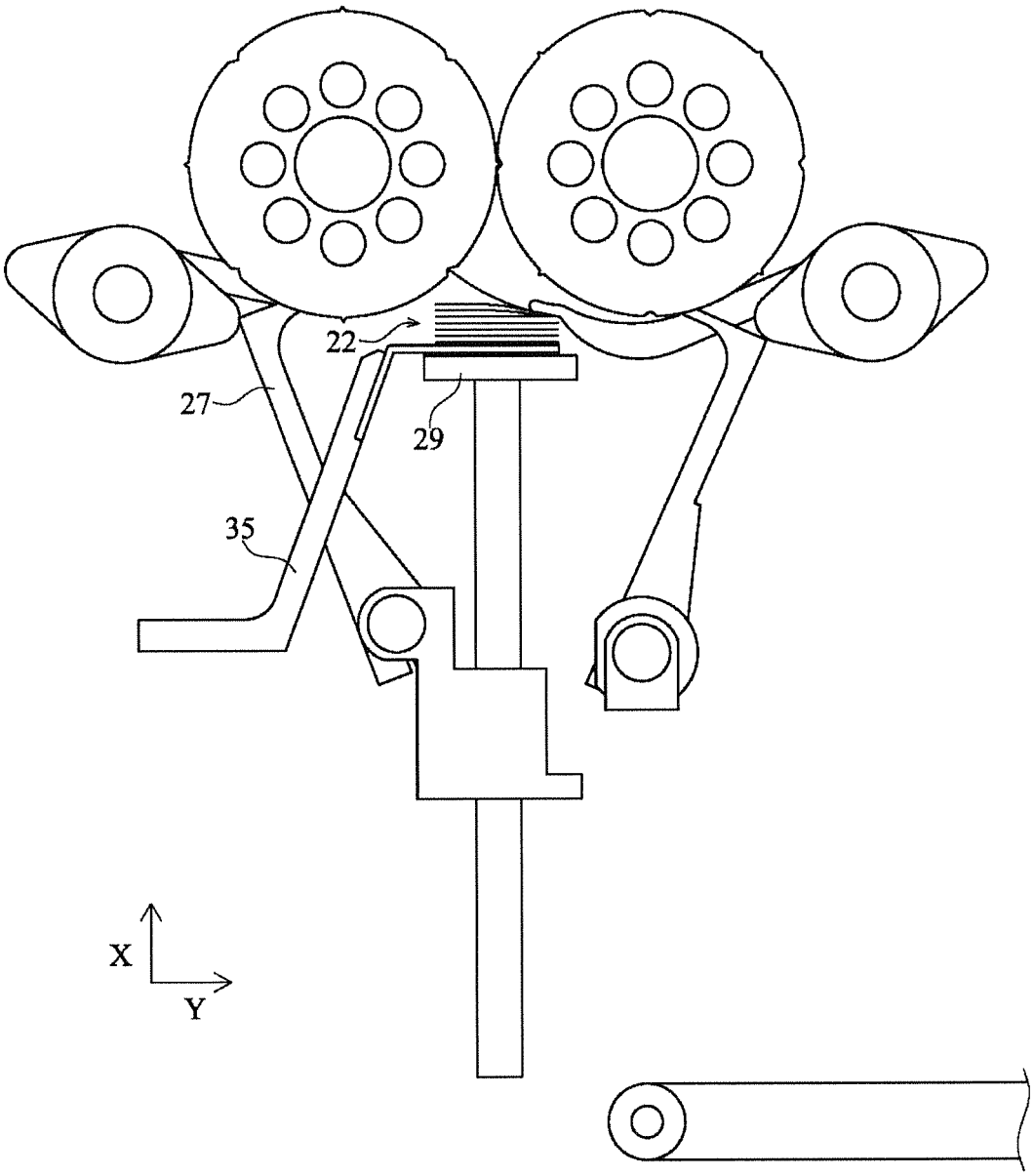

After delivery of one finished stack of interfolded web products 22 to the assigned location, the stoppage unit 27 and the holder 29 are moved upwards along the first direction X. When the holder 29 reaches the set position, the second carrier unit 35 is retracted along the second direction Y, enabling the holder 29 to receive folded web products 22 from the second carrier unit 35. In one embodiment of the invention, the first direction X is perpendicular to the second direction Y, as shown in FIG. 5D.

In actual application, the web products 22 can be folded and stacked by means of continuously repeating the steps of FIGS. 5A-5D. In another embodiment of the present invention, the web product folding and stacking machine 20 eliminates the aforesaid second carrier unit 35, and uses the holder 29 to receive the finished stack of interfolded web products 22 from the first carrier unit 25 directly.

The folding fingers 23, the first carrier unit 25, a stoppage unit 27 and/or the second carrier unit 35 can be finger shape, and can be alternatively arranged at different elevations, facilitating folding, stacking, separation and/or delivery of web products 22.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A web product folding and stacking machine, comprising:

two folding line making rolls arranged in proximity to each other for transferring web products and causing each said web product to form a folding line thereon;

two folding fingers adapted to fold up each said web products along the folding line thereof for enabling said web products to be stacked up in an interfolded condition;

a first carrier unit, having a first surface and a second surface opposite to said first surface, wherein said first surface of said first carrier unit is adapted to carrying said interfolded web product;

at least one suction device arranged on said first surface of said first carrier unit for sucking said interfolded web product on said first surface of said first carrier unit, wherein said first surface is a top surface of said first carrier unit;

a stoppage unit adapted to isolate said interfolded web products; and a holder adapted to hold said interfolded web products.

2. The web product folding and stacking machine as claimed in claim 1, further comprising a second carrier unit adapted to receive the interfolded web product from said first carrier unit.

3. The web product folding and stacking machine as claimed in claim 2, wherein said holder is adapted to receive said interfolded web products from said second carrier unit.

4. The web product folding and stacking machine as claimed in claim 2, wherein said stoppage unit and said holder are movable in a first direction, said second carrier unit is movable in a second direction, and said first direction is perpendicular to said second direction.

5. The web product folding and stacking machine as claimed in claim 1, wherein said first carrier unit comprises a plurality of fingers, and said suction device is arranged on said fingers.

6. The web product folding and stacking machine as claimed in claim 5, wherein said suction device is adapted to form negative pressure.

7. The web product folding and stacking machine as claimed in claim 1, wherein said folding line making rolls comprise a first folding line making roll and a second folding line making roll, and said first folding line making roll and said second folding line making roll comprise a plurality longitudinal protrusions and a plurality of longitudinal grooves.

8. The web product folding and stacking machine as claimed in claim 7, wherein said longitudinal protrusions and said longitudinal grooves of said first folding line making roll are engaged into said longitudinal grooves and said longitudinal protrusions of said second folding line making roll respectively.

9. The web product folding and stacking machine as claimed in claim 1, wherein said first carrier unit and said stoppage unit are finger shape.

10. The web product folding and stacking machine as claimed in claim 1, wherein said suction device is adapted to form negative pressure.

11. The web product folding and stacking machine as claimed in claim 1, wherein said holder is adapted to receive the interfolded web product from said first carrier unit.

12. The web product folding and stacking machine as claimed in claim 1, further comprising a conveyer for receiving said interfolded web products from said stoppage unit and said holder.

* * * * *